US006097008A

United States Patent [19]

Mahin

[11] Patent Number: 6,097,008

[45] Date of Patent: Aug. 1, 2000

[54] SEWER VENT PIPE ANTI ICE-BUILD-UP APPARATUS

[76] Inventor: Kenneth L. Mahin, 710 3rd St. S.E., Pipestone, Minn. 56164

[21] Appl. No.: 09/175,005

[22] Filed: Oct. 19, 1998

[51] Int. Cl.[7] ..... H05B 3/06; H05B 1/00

[52] U.S. Cl. ..... 219/523; 219/213

[58] Field of Search ..... 219/523, 213, 219/201, 535; 392/458, 459, 478; 138/33

[56] References Cited

U.S. PATENT DOCUMENTS

| | | | |
|---|---|---|---|
| 3,766,357 | 10/1973 | Koester | 392/478 |
| 3,985,994 | 10/1976 | Eloranta et al. | 219/201 |
| 4,110,603 | 8/1978 | Perterson et al. | 219/535 |
| 4,192,988 | 3/1980 | Pederson et al. | 219/201 |
| 4,423,311 | 12/1983 | Varney | 219/306 |
| 4,436,988 | 3/1984 | Blumenkranz | 219/544 |
| 4,524,262 | 6/1985 | Meyer | 219/213 |
| 5,129,387 | 7/1992 | Behrens | 126/440 |
| 5,214,266 | 5/1993 | Halone | 219/201 |
| 5,360,333 | 11/1994 | Schmidt | 425/549 |
| 5,444,227 | 8/1995 | Chestnut | 219/506 |
| 5,591,367 | 1/1997 | Schwarkopf | 219/535 |

*Primary Examiner*—Teresa Walberg
*Assistant Examiner*—Daniel Robinson
*Attorney, Agent, or Firm*—Roger W. Jensen

[57] ABSTRACT

An annularly shaped housing extension is adapted to be inserted into the top of a coupling, the bottom of which is fitted on to the top end of a sewer vent pipe, the housing containing heating cable which, when energized, causes the transfer of heat from the heating cable to an inner sleeve of the housing which becomes a defacto extension of the vent pipe.

1 Claim, 4 Drawing Sheets

SEWER VENT PIPE ANTI ICE-BUILD-UP APPARATUS

BACKGROUND OF THE INVENTION

This invention relates to the long-standing problem of the freezing over of the top of sewer vent pipes. The problem occurs during cold weather when relatively warm and relatively moist air and other gases rise upwardly through the sewer vent pipes and encounter below-freezing conditions. The problem is aggravated if concurrently there is precipitation, e.g., snow or sleet. The problem is universal in that it occurs in all areas of the world having cold climates.

Vent pipes are typically vertically oriented and extend upwardly through a roof structure, terminating with an opening through which the sewer gases, odors, etc., are intended to exit. The flow of the gases, etc., in the vent pipe is typically upwardly and also typically contains some water vapor.

During times when the outside or ambient air temperature falls below the freezing point, i.e., 32° F., then it is possible for the aforesaid water vapor to accumulate in the form of ice on the inside of the sewer vent pipe, especially adjacent to the top opening thereof. As is well understood, the build up of ice can progress to the point where the sewer vent pipe is completely blocked off or sealed over by the build up of ice. Concurrently the build up can be aided by rain or snow which may be falling in the area. A complete blockage of the vent pipe can result in sewer gas entering the building; a very undesirable and sometimes dangerous condition.

Thus the problem is well known and long-standing, and there have been a number of prior art proposed solutions to the problem, none of which have been fully satisfactory, all things considered.

First of all, my co-pending U.S. patent application Ser. No. 08/806,170 filed Feb. 26, 1997, overcame a number of prior art problems but required a customized apparatus for each size of sewer vent pipe. To explain, those skilled in the art understand that there is quite a range of diameters of sewer vent pipes; vent pipes are frequently found in the range of 1½inches, 2 inches, 3 inches, 4 inches, 5 inches and other. Further, some vent pipes are constructed of metal such as steel, while others are made out of plastic such as polyvinyl chloride (PVC).

Meyer, U.S. Pat. No. 4,524,262 has an elaborate and expensive defroster which is labor intensive in its installation. Also, there is no convenient means for knowing whether or not the system is operating.

Another prior art arrangement is Stadheim, U.S. Pat. No. 4,442,642; an insulating sleeve is positioned over a sewer vent pipe. This prior art arrangement has very low effectiveness against the build up of ice and, once a build up has occurred, there are no means for facilitating the removal thereof.

Behrens, U.S. Pat. No. 5,129,387 proposes the prevention of the formation of ice in a vent pipe by the gathering and focusing of solar radiation and distributing the radiation to the vent pipe in the form of heat in an attempt to provide an ambient temperature in the pipe above the freezing point of water. This approach, in addition to being costly, has some inherent and obvious limitations, i.e., long winter nights in areas having cold climates and the possibility of cloudy weather for obscuring the sunlight.

Yet another prior art apparatus is disclosed in Halone, Jr., U.S. Pat. No. 5,214,266 wherein an electric heating attachment is suspended at the top of a sewer vent and extends down within the sewer vent. This complex arrangement has not proven satisfactory.

SUMMARY OF THE INVENTION

The present invention is intended to be used in combination with a vertically-oriented hollow sewer vent pipe, the diameter of which may, from building to building, vary according to the original builder's decision as to both pipe diameter and as to the selection of the pipe material. It will be understood that the subject invention usually will be used as an add-on or as an accessory on an after-market basis for most installations. Thus a typical scenario would be a house located in a cold climate, having a vertically oriented, hollow sewer vent pipe having a longitudinal axis and a preselected outer diameter. The vent pipes typically project upwardly through a roof structure, terminating with a top end which is at a preselected distance above the portion of the roof structure through which the vent pipe projects.

The present invention provides an annularly-shaped housing having a longitudinal axis and an outer sleeve extending longitudinally a preselected distance. The housing further comprises an inner sleeve concentrically positioned within said outer sleeve and spaced therefrom to define a longitudinally extending annular space. The inner sleeve has a longitudinal extent or length greater than the outer sleeve. The housing is further characterized by having i) top cap means connected to one end of both inner and outer sleeves, and further having a central opening concentric with said sleeves and being adapted to close off one end of said longitudinally extending annular space; ii) lower cap means connected to the other end of said outer sleeve and to the outer surface of said inner sleeve a preselected distance from the other end thereof, to close off the other end of said longitudinally extending annular space; and iii) a preselected length of electric heating cable coiled within and extending longitudinally along said longitudinally extending annular space.

Control means are provided for selectively connecting the electric heating cable to a source of electric power, the control means including thermostat means so as to selectively energize the cable to produce heat so as to raise the temperature of the inner sleeve of the housing.

A very important, unique feature of the present invention is an adapter coupler means used to couple the housing to the top end of the sever vent pipe. More specifically, the adapter coupler means comprises a hollow tubular annularly shaped member having i) a first end having an inner diameter adapted to snugly receive the other or bottom end of said inner sleeve; and ii) a second end having an inner diameter adapted to snugly receive said top end of said sewer vent pipe.

Thus the housing may be mounted on and connected to said top end of said vent pipe, with the longitudinal axes thereof being in register, and with the adapter coupler means being positioned intermediate said housing and said vent pipe. Thus the housing is firmly connected to the top end of the vent pipe and the inner sleeve of the housing becomes a defacto extension of the vent pipe with the apparatus functioning, when the heating cable is energized, to produce heat so as to raise the temperature of the inner sleeve to prevent the build up of ice within said inner sleeve.

The housing and the coupler means are thus supported solely by the sewer vent pipe. The installation of the housing is very rapid and requires no special skills or modifications as is the case, for example, with the above noted U.S. Pat. No. 4,524,262. The installer, in practice, would either ascertain ahead of time the exact diameter of the sewer vent pipe so as to preselect a coupler means of the appropriate diameter. Alternatively, the installer could have an assortment of couplers available for the installation. It should be noted that the couplers are standard commercial products, readily available in hardware and building supply stores.

The control means for the apparatus is, in the preferred embodiment, located in a small enclosure attached to the exterior of the outer sleeve and contains a thermostatic means which responds to the ambient air temperature external of the sewer vent pipe. In the preferred embodiment, the control means includes an electric lamp or equivalent, which is visible to a remotely located human eye, when the heating cable is being energized. Thus the owner-operator or other person may stand at ground level and view the vent pipe with housing mounted thereon, from afar. If the heating cable is being energized, then the electric lamp signaling means will be energized and will be illuminated to provide a visual signal. During periods when the thermostat is not calling for heat to be applied to the inner sleeve, then the electric signal light will not be illuminated.

DETAILED DESCRIPTION OF THE INVENTION

Figure 1:
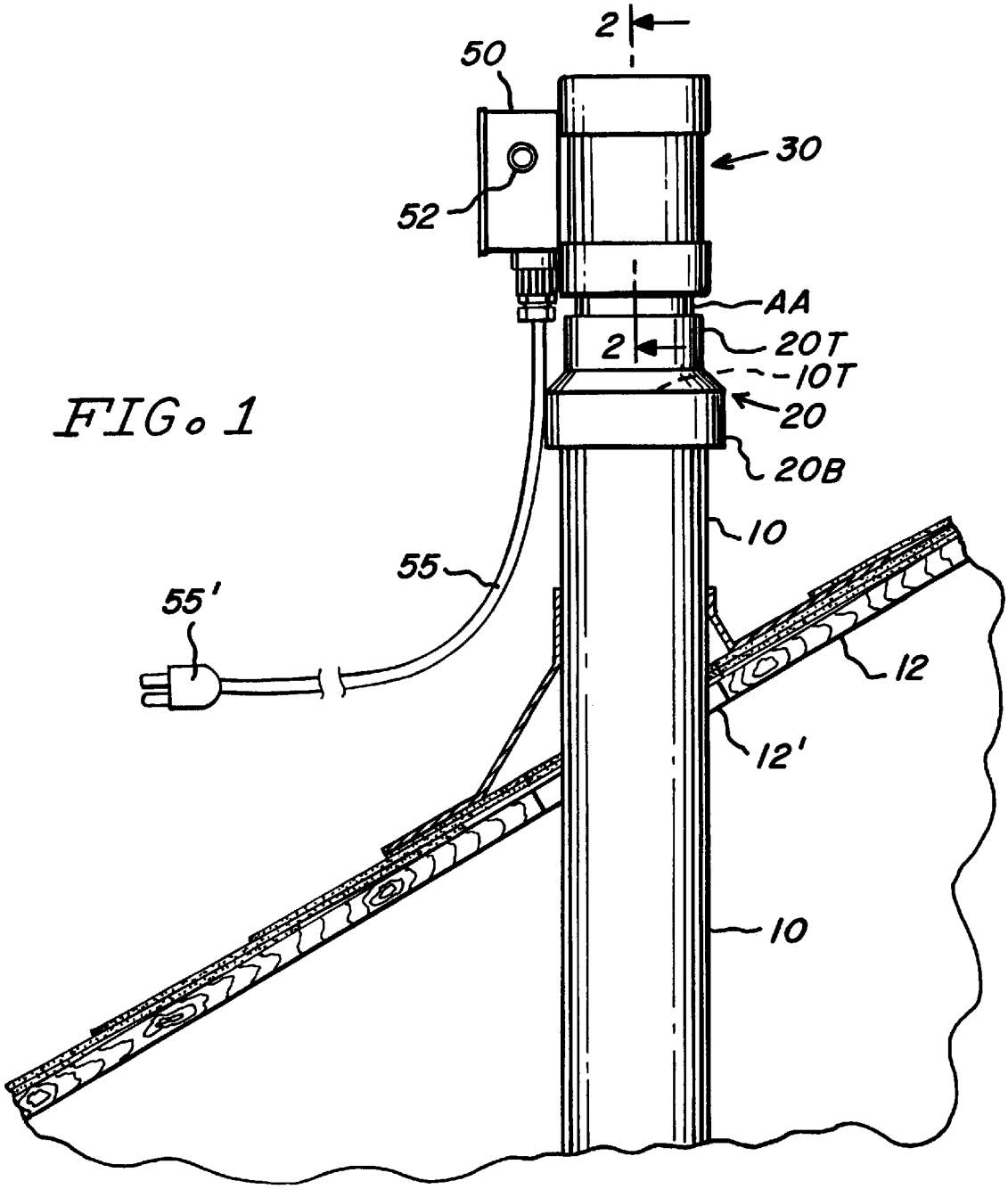
FIG. 1 is a schematic showing of a cross section of a portion of a roof structure through which extends a vertically oriented sewer vent pipe of the top end of which is positioned my unique housing for preventing the build up of ice within the housing.

Referring to FIG. 1, a vertically oriented, hollow sewer vent pipe 10 is shown projecting through an opening 12' of a roof structure 12. The vent pipe 10, for this embodiment, is representative of a plastic type (such as PVC) pipe in widespread use at this time. As is well known, the PVC pipe is available in various preselected outside diameters such as 1 ½", 2", 3" and 4" by way of nonlimiting examples. The vent pipe may also be of metal, depending on the local building code and/or builder's choice, a metal vent pipe configuration being depicted in FIG. 7 to be discussed below. The top end of the sewer vent pipe is somewhat obscured in FIG. 1 by a special, unique adapter coupler means 20 but the top end is generally designated by the reference 10T, with the dotted lead line thereof going to the approximate location of said top end of the sewer vent pipe.

Figure 2:
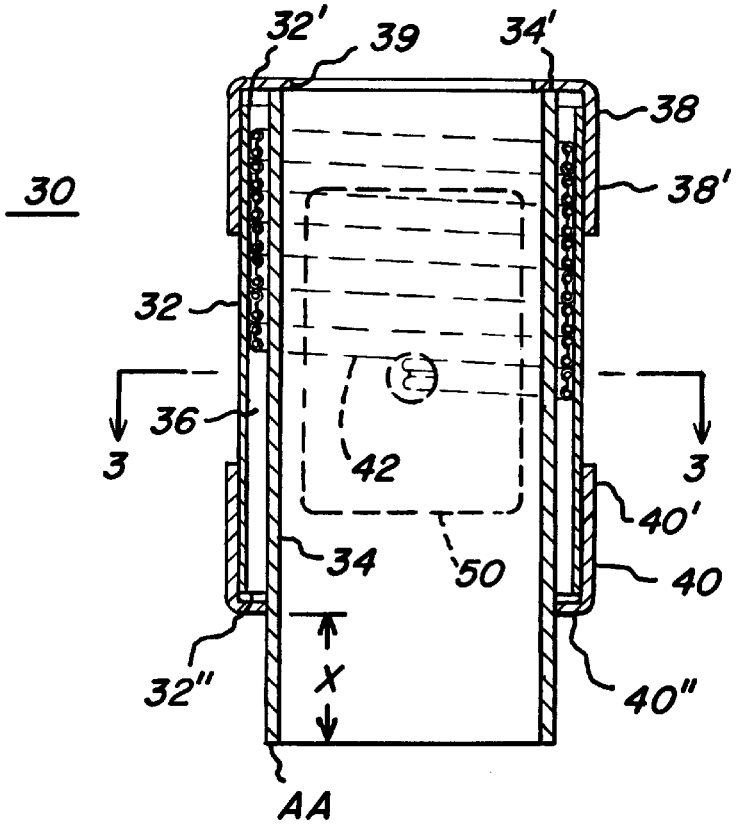
FIG. 2 is a longitudinal cross section of my unique housing as viewed along section lines 2—2 of FIG. 1.

The unique heater housing provided by this invention is shown in FIG. 1, designated by reference numeral 30 and is shown in cross section in FIG. 2. The housing has a longitudinal axis and an outer sleeve 32 extending longitudinally a preselected distance, the top end of the outer sleeve being identified by reference numeral 32' and bottom end being identified by 32". An inner sleeve 34 is concentrically positioned within the outer sleeve 32 and spaced therefrom to define a longitudinally extending annular space 36. The top end of the inner sleeve 34 is identified by reference numeral 34' and the bottom end by designator AA. It will be noted that the inner sleeve 34 has a significantly longer longitudinal extent than the outer sleeve 32, the significance of which will become readily apparent below. The housing is further characterized by having a top cap means 38 connected to the top ends 32' and 34' of both inner and outer sleeves 32 and 34 respectively. The cap 38 further has a central opening 39 concentric with the sleeves. Importantly, it will be noted from FIG. 2 that the cap 38 effectively closes off one end of the longitudinally extending annular space 36.

The housing further includes a lower cap means 40 connected to the other or bottom end of the outer sleeve 32, as well as being connected to the outer surface of the inner sleeve 34 at a preselected distance from the bottom or other end thereof AA to thus close off the other end of said longitudinally extending annular space 36. It will be noted in FIG. 2 that the length of the portion of inner sleeve 34 that extends beyond the end surface 40" of cap 40 is identified in FIG. 2 as a dimension "X".

Figure 3:
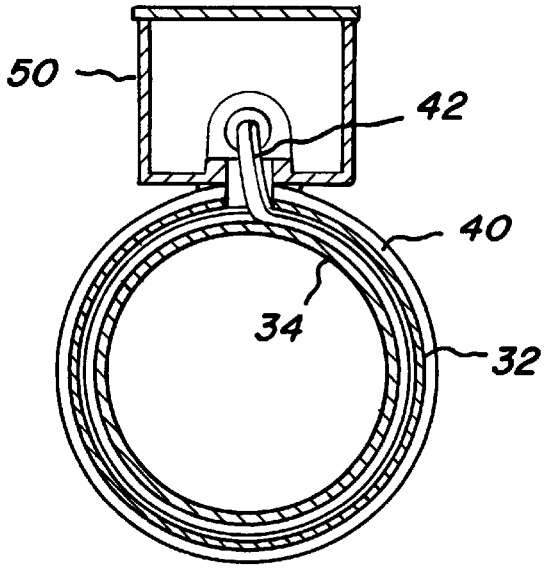
FIG. 3 is a transverse cross section of the housing as viewed along section lines 3—3 of FIG. 2.

A preselected length of heating cable 42 is primarily disposed in coils in the annular space 36 and emanates from a control box 50 fastened by appropriate means to the exterior of the outer sleeve 32 as is shown in FIGS. 1–3. Control box 50 also serves as a junction box for connecting, via thermostatic control (contained in box 50) the aforesaid end of the cable 42 to a suitable source of electric power, this being represented in FIG. 1 by a standard heavy-duty electric cord 55, the male plug end 55' of which may be connected to an extension cord (not shown). It should be understood that because of the nature of the connection between the unique housing and the sewer pipe that building codes do not require special dedicated electrical outlets or connections for the housing.

Figure 4:
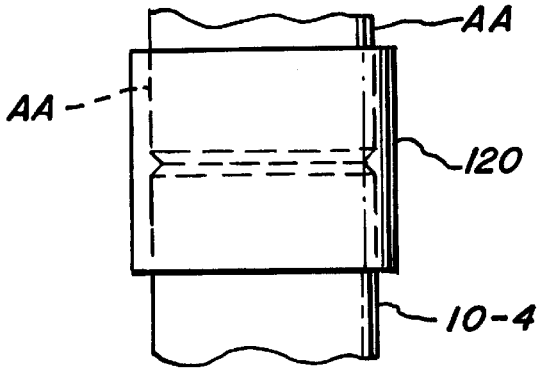
FIGS. 4, 5 and 6 are elevational views of coupler means for coupling the housing to plastic sewer vent pipes of three different diameters, the adapter coupler being preferably made out of PVC material and adapted to co-act with sewer vent pipes also made out of PVC material.
Figure 5:
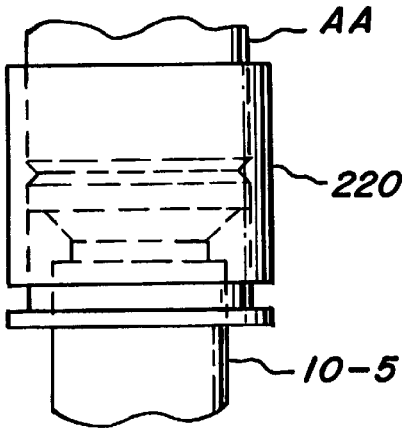
Figure 6:
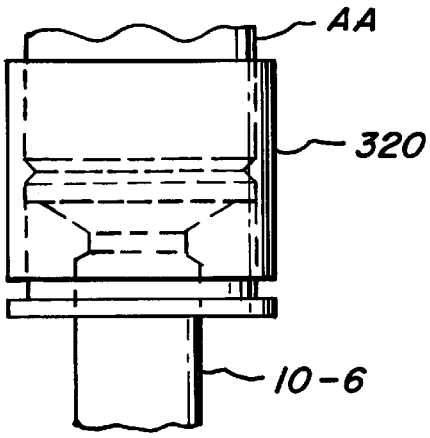

Referring again to FIG. 1, it is seen that the sewer vent pipe 10 has (for this scenario) a larger diameter than the diameter of the inner sleeve 34, the bottom extension AA of which is identified in FIG. 1. Thus, for this scenario, the coupler 20 has a bottom portion 20B having an inner diameter adapted to snugly receive the top end of the sewer vent pipe 10 and a top portion 20T having an inner diameter adapted to snugly receive the end AA of the inner sleeve 34. As indicted above, the coupler 20 shown in FIG. 1 (and also the couplers 120, 220 and 320 shown respectively in FIGS. 4, 5 and 6), are all standard commercial-type couplings for PVC-type pipe products readily available at hardware and building supply stores.

Thus, to install the apparatus shown in FIG. 1, all that is required is to preselect the appropriate coupling, install it on the top of the sewer vent pipe, and then insert the extension M of the unique housing into the top portion 20T of the coupling 20. No special adhesives or cements or required or desired. The electric cord 55 is then subsequently plugged into an appropriate source of power, e.g., an extension cord, and the job is completed.

Figure 7:
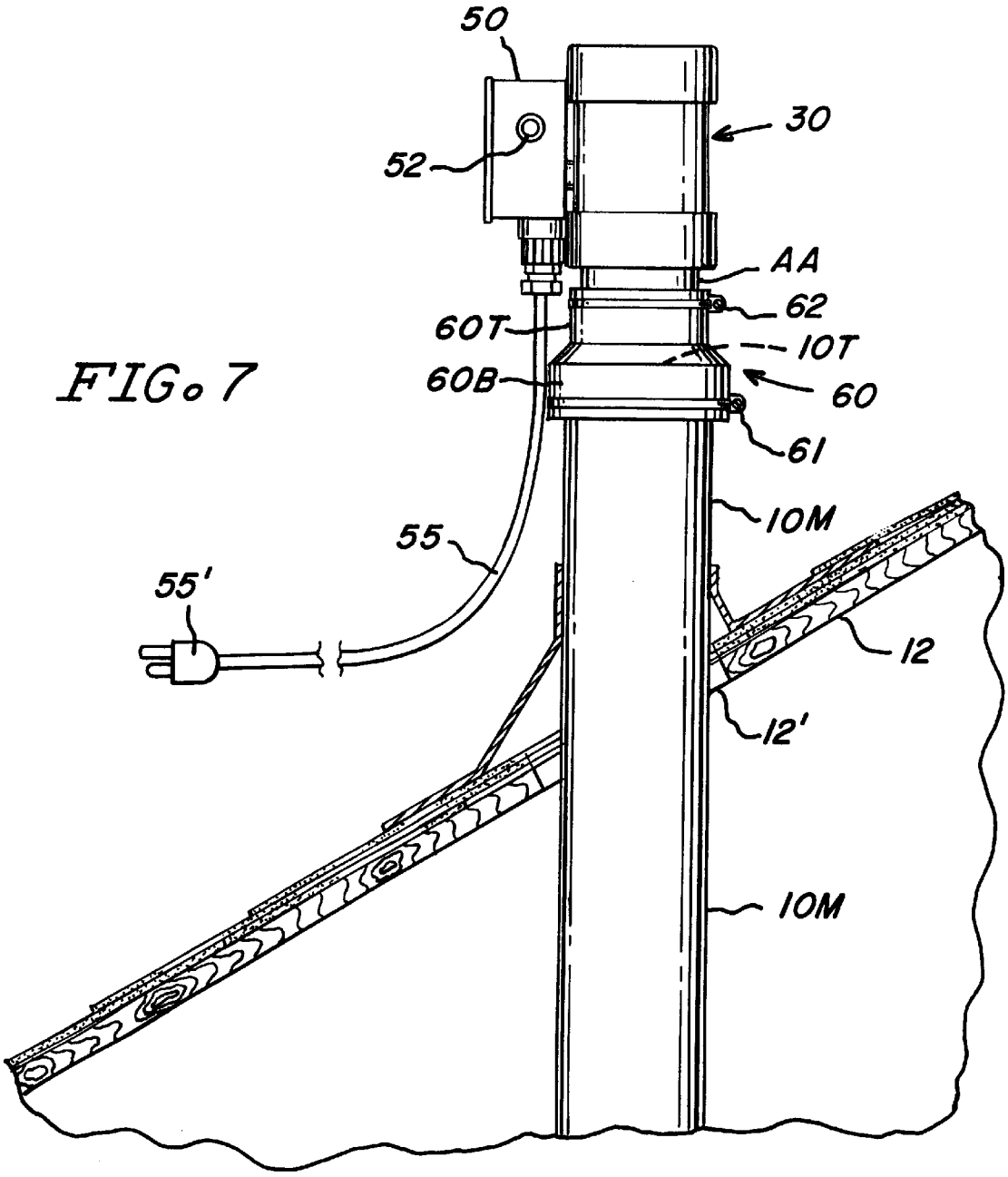
FIG. 7 is similar to FIG. 1 and shows my unique housing connected to a metallic sewer vent pipe using an alternate form of adapter coupler means.

Referring to FIG. 7, the sewer vent pipe shown is intended to depict a metal pipe such as steel and has been identified by reference numeral 10M. Once again it extends through an opening 12' of the roof 12 and has a top end 10T. The same unique housing 30 having exposed inner sleeve portion AA is provided. A unique coupler 60 is depicted very similar to the PVC unit 20 shown in FIG. 1 in function, except that the material is a hard rubber-like material. Again, these couplers are readily available in hardware and building supply stores. In FIG. 7 the lower or bottom end 60B of coupler 60 is shown to have a larger diameter than the upper end 60T. Each end of the coupler 60 has an externally mounted hose clamp type clamp means 61 and 62, having a rotatable screw-type means for tightening or loosening the coupler as is well understood by those skilled in the art.

Once again, the apparatus depicted in FIG. 7 can be very quickly installed by a non-skilled person. With a preselected coupler 60 mounted on top of the vent pipe 10M and secured thereto by an appropriate tightening of the clamp 61, the housing 30 is then installed. More specifically, the end AA of the inner sleeve 34 is inserted into the top portion 60T of the coupler 60, and the clamp 62 tightened as appropriate.

Figure 8:
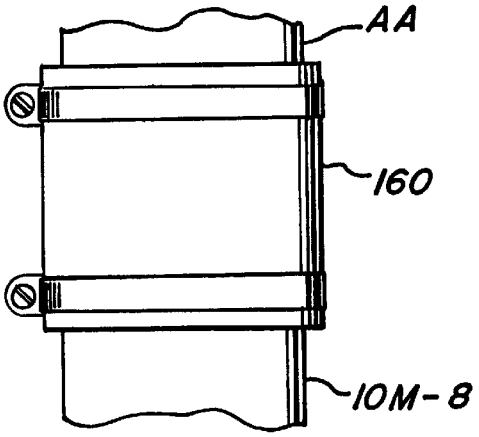
FIGS. 8, 9 and 10 show elevational views of three couplers of the modified type co-acting with sewer vent pipes of three different diameters.
Figure 9:
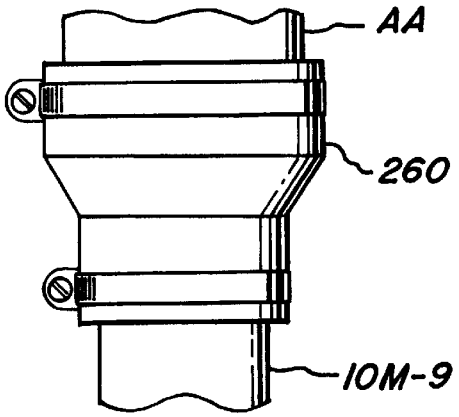
Figure 10:
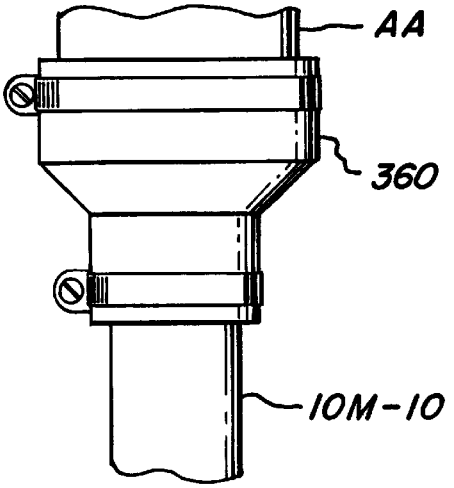

As noted, the arrangement shown in FIG. 7 has a sewer vent pipe diameter larger than the diameter of sleeve 34. FIGS. 8, 9 and 10 show other scenarios. FIG. 8 shows a coupler 160 for the case of the sewer vent pipe being essentially the same diameter as the diameter of AA. FIG. 9 shows the case for the sewer vent pipe being somewhat smaller in diameter than AA and FIG. 10 shows the case where the vent pipe is much smaller in diameter than the inner sleeve 34.

While a preferred embodiment of the invention has been illustrated, it will be understood that variations may be made by those skilled in the art without departing from the inventive concept. Accordingly, the invention is to be limited only by the scope of the following claims.

What is claimed is:

1. In combination with a vertically oriented, hollow sewer vent pipe having a longitudinal axis and a preselected outer diameter projecting upwardly through a roof structure and terminating with a top end a preselected distance above the portion of the roof structure through which said vent pipe projects, an apparatus mounted on and solely supported by said top end of said vent pipe for preventing the build up of ice within said sewer vent pipe, said apparatus comprising:

a) an annularly shaped housing having a longitudinal axis, and an outer sleeve extending longitudinally a preselected distance, an inner sleeve concentrically positioned within said outer sleeve and spaced therefrom to define a longitudinally extending annular space, said inner sleeve having a longitudinal extent greater than said outer sleeve, said housing being further characterized by having (i) top cap means connected to one end of both said inner and outer sleeves and further having a central opening concentric with said sleeves and adapted to close off one end of said longitudinally extending annular space; (ii) lower cap means connected to the other end of said outer sleeve and to the outer surface of said inner sleeve a preselected distance from the other end thereof to close off the other end of said longitudinally extending annular space; and (iii) a preselected length of electric heating cable coiled within and extending longitudinally along said longitudinally extending annular space;

b) control means including thermostat means connected to said electric heating cable and adapted to be connected to a source of electric power to selectively energize said cable to produce heat to raise the temperature of said inner sleeve; and c) an adapter coupler comprising a hollow tubular annularly shaped member having (i) a first end having an inner diameter adapted to snugly receive the other end of said inner sleeve; and (ii) a second end having an inner diameter adapted to snugly receive said top end of said sewer vent pipe, whereby said housing is mounted on, connected to, and solely supported by said top end of said vent pipe with said longitudinal axes thereof being in register and with said adapter coupler being positioned intermediate said housing and said vent pipe as aforesaid so that said inner sleeve becomes a defacto extension of said vent pipe and said apparatus functioning, when said heating cable is energized, to produce heat to raise the temperature of said inner sleeve to prevent the build up of ice within said inner sleeve.

* * * * *